US011777233B2

(12) United States Patent
Koellmann

(10) Patent No.: US 11,777,233 B2
(45) Date of Patent: Oct. 3, 2023

(54) CONDUCTOR CONNECTION TERMINAL

(71) Applicant: WAGO Verwaltungsgesellschaft mbH, Minden (DE)

(72) Inventor: Hans-Josef Koellmann, Minden (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 42 days.

(21) Appl. No.: 17/152,363

(22) Filed: Jan. 19, 2021

(65) Prior Publication Data

US 2021/0143560 A1 May 13, 2021

Related U.S. Application Data

(63) Continuation of application No. PCT/EP2019/069463, filed on Jul. 19, 2019.

(30) Foreign Application Priority Data

Jul. 19, 2018 (DE) ..... 10 2018 117 508.6

(51) Int. Cl.

| | |
|---|---|
| ***H01R 4/48*** | (2006.01) |
| ***H01R 11/11*** | (2006.01) |
| ***H01R 13/11*** | (2006.01) |
| ***H01R 13/508*** | (2006.01) |

(52) U.S. Cl.

CPC ..... *H01R 4/4836* (2013.01); *H01R 11/11* (2013.01); *H01R 13/11* (2013.01); *H01R 13/508* (2013.01)

(58) Field of Classification Search

CPC .. H01R 4/4836; H01R 4/4845; H01R 4/4818; H01R 4/4827; H01R 9/24; H01R 9/2416;

(Continued)

(56) References Cited

U.S. PATENT DOCUMENTS 7,281,942 B2 10/2007 Swedberg et al.
8,192,226 B2 * 6/2012 Keswani ..... H01R 4/4818 439/441

(Continued)

FOREIGN PATENT DOCUMENTS

AT 353352 B 11/1979
CN 2435856 Y 6/2001

(Continued)

OTHER PUBLICATIONS

International Search Report dated Oct. 29, 2019 in corresponding application PCT/EP2019/069463.

(Continued)

*Primary Examiner* — Felix O Figueroa
(74) *Attorney, Agent, or Firm* — Muncy, Geissler, Olds & Lowe, P.C.

(57) ABSTRACT

A conductor connection terminal having an insulating material housing that includes a conductor insertion opening having a conductor insertion channel attached to the conductor insertion opening and a contact pin insertion opening having a contact pin insertion channel attached to the contact pin insertion opening. The conductor connection terminal also has a busbar and a clamping spring. The busbar includes a first contact portion and a second contact portion and the clamping spring has a first clamping limb having a first clamping edge oriented towards the first contact portion of the busbar, a first spring bow, a bearing limb, a second spring bow and a second clamping limb.

14 Claims, 3 Drawing Sheets

(58) Field of Classification Search
CPC ..... H01R 12/515; H01R 4/48; H01R 9/2408; H01R 24/30; H01R 13/506; H01R 4/489; H01R 4/5008; H01R 13/502; H01R 24/22; H01R 9/223; H01R 11/09; H01R 12/88; H01R 13/447; H01R 13/5829; H01R 4/22; H01R 4/40; H01R 9/2491; H01R 11/05; H01R 13/113; H01R 13/426; H01R 13/50; H01R 13/501; H01R 13/508; H01R 13/6275; H01R 13/62905; H01R 13/639; H01R 2103/00; H01R 2105/00; H01R 43/16; H01R 43/20; H01R 4/44; H01R 4/52; H01R 9/26; H01R 9/2675; H01R 12/58; H01R 12/707; H01R 12/716; H01R 12/721; H01R 12/728; H01R 12/75; H01R 13/04; H01R 13/112; H01R 13/115; H01R 13/193; H01R 13/436; H01R 13/512; H01R 13/5833; H01R 13/6273; H01R 13/743; H01R 2101/00; H01R 2107/00; H01R 2201/20; H01R 24/20; H01R 24/76; H01R 25/162; H01R 43/18; H01R 4/26; H01R 4/28; H01R 4/42; H01R 4/5066; H01R 4/58; H01R 9/2608
See application file for complete search history.

(56) References Cited

U.S. PATENT DOCUMENTS

| | | | | |
|---|---|---|---|---|
| 8,388,387 | B2 * | 3/2013 | Koellmann | H01R 4/4845 439/729 |
| 8,444,443 | B2 * | 5/2013 | Schafmeister | H01R 4/4836 439/725 |
| 8,794,994 | B2 * | 8/2014 | Kollmann | H01R 13/627 439/441 |
| 9,466,895 | B2 * | 10/2016 | Kollmann | H01R 4/4836 |
| 9,525,218 | B2 * | 12/2016 | Wu | H01R 4/4818 |
| 9,543,700 | B2 * | 1/2017 | Kollmann | H01R 4/4836 |
| 10,014,596 | B2 | 7/2018 | Hartmann | |
| 10,033,119 | B2 | 7/2018 | Koellmann | |
| 10,164,349 | B2 * | 12/2018 | Koellmann | H01R 9/2675 |
| 10,193,245 | B2 * | 1/2019 | Lorenschat | H01R 4/4845 |
| 10,622,730 | B2 * | 4/2020 | Wu | H01R 4/4845 |
| 10,707,594 | B1 * | 7/2020 | Wu | H01R 4/4836 |
| 11,043,759 | B2 * | 6/2021 | Ober-Woerder | H01R 4/4845 |

FOREIGN PATENT DOCUMENTS

| | | | |
|---|---|---|---|
| DE | 2515842 | A1 | 10/1976 |
| DE | 8523263 | U1 | 10/1985 |
| DE | 9309139 | U1 | 8/1993 |
| DE | 19949387 | A1 | 5/2001 |
| DE | 20210105 | U1 | 10/2002 |
| DE | 10261536 | B4 | 12/2009 |
| DE | 102014119421 | A1 | 6/2016 |
| DE | 102015107853 | A1 | 11/2016 |
| EP | 1152489 | A2 | 11/2001 |
| LU | 30906 | A1 | 12/1952 |

OTHER PUBLICATIONS

International Preliminary Report on Patentability dated Jan. 28, 2021 in corresponding application PCT/EP2019/069463.

* cited by examiner

CONDUCTOR CONNECTION TERMINAL

This nonprovisional application is a continuation of International Application No. PCT/EP2019/069463, which was filed on Jul. 19, 2019 and which claims priority to German Patent Application No. DE 10 2018 117 508.6, which was filed in Germany on Jul. 19, 2018 and which are both herein incorporated by reference.

BACKGROUND OF THE INVENTION

Field of the Invention

The present invention relates to a conductor connection terminal comprising an insulating material housing, wherein the insulating material housing has a conductor insertion opening with a conductor insertion channel attached to the conductor insertion opening and a contact pin insertion opening having a contact pin insertion channel attached to the contact pin insertion opening, having a busbar, wherein the busbar has a first contact portion and a second contact portion, having a clamping spring, wherein the clamping spring has a first clamping limb with a first clamping edge oriented towards the first contact portion of the busbar, a first spring bow, a bearing limb, a second spring bow, and a second clamping limb, wherein the first clamping edge and the first contact portion of the busbar form a first clamping point for an electrical conductor that is to be clamped, wherein the second clamping limb and the second contact portion of the busbar form a second clamping point for a contact pin that is to be clamped, wherein the first spring bow is connected to the second spring bow by means of the bearing limb.

Description of the Background Art

DE 102 61 536 B4 reveals a connecting terminal for electrical conductors, wherein the electrical conductors are clamped to a printed circuit board by means of a clamping spring insert. The clamping spring insert has two spring bows, each with a spring arm that is designed to clamp the respective electrical conductor to the printed circuit board. The spring bows are connected to each other via a common bearing limb, wherein the spring bows are bent in the same direction from the bearing limb. In order to enable the insertion of two electrical conductors, the spring bows are arranged at different height levels.

DE 202 10 105 U1 discloses a connector with a contact insert, wherein the contact insert is formed of a busbar portion and a steel spring suspended therein. The steel spring is S-shaped and forms a clamping point with the busbar part for an electrical conductor that is to be clamped and a further clamping point for a contact pin that is to be clamped. One limb end of the steel spring is bent away from the clamping point in the region of the clamping point for the contact pin that is to be clamped, so that the contact pin can be inserted into the connector from two sides.

SUMMARY OF THE INVENTION

It is therefore an object of the present invention to provide an improved conductor connection terminal.

It is proposed, in an exemplary embodiment, that the first spring bow and the second spring bow are substantially arranged at a common height level of the conductor connection terminal, wherein the height level is substantially parallel to the direction of longitudinal extent of the conductor insertion channel and/or to the direction of longitudinal extent of the contact pin insertion channel, at least in the state without clamped electrical conductor and without clamped contact pin. Substantially parallel can mean a deviation of the height level of up to 10° (starting from a 360° system) with respect to the parallelism of the height level to the direction of longitudinal extent of the conductor insertion channel and/or the direction of longitudinal extent of the contact pin insertion channel. The height level can also run exactly parallel to the direction of longitudinal extent of the conductor insertion channel and/or the direction of longitudinal extent of the contact pin insertion channel. In this way, a compact conductor connection terminal can be provided, which enables an electrically conductive connection between a contact pin and an electrical conductor. The common height level of the first and the second spring bow enables the provision of a clamping spring which requires only a very small installation space within the conductor terminal connection.

An electrical conductor can be inserted into the conductor connection terminal via the conductor insertion opening and the subsequent conductor insertion channel in a conductor insertion direction towards the first clamping point. Similarly, a contact pin can be inserted into the conductor connection terminal via the contact pin insertion opening and the adjacent contact pin insertion channel can be inserted in a contact pin insertion direction towards the second clamping point.

The direction of longitudinal extent of the conductor insertion channel is the direction in which the electrical conductor can be inserted into the conductor insertion channel. Similarly, the direction of longitudinal extent of the contact pin insertion channel is the direction in which the contact pin can be inserted into the contact pin insertion channel. According to the invention, the conductor insertion channel and/or the contact pin insertion channel are aligned parallel to the common height level of the first spring bow and the second spring bow. Accordingly, the conductor insertion direction and/or the contact pin insertion direction are aligned parallel to the height level of the first spring bow and the second spring bow.

The height level is an imaginary plane defined by the vertices of the first spring bow and the second spring bow, oriented substantially or exactly parallel to the direction of longitudinal extent of the conductor insertion channel and/or the direction of longitudinal extent of the contact pin insertion channel. The height level may also be an imaginary plane intersecting the first spring bow and the second spring bow at any point, oriented substantially or exactly parallel to the direction of longitudinal extent of the conductor insertion channel and/or the direction of longitudinal extent of the contact pin insertion channel. It has been shown that for an optimal compact design of the conductor connection terminal, the height level is aligned parallel to both the direction of longitudinal extent of the conductor insertion channel and the direction of longitudinal extent of the contact pin insertion channel.

A common height level can be provided, for example, by offsetting the bearing limb so that the subsequent spring bows (first spring bow and second spring bow) are at a common height level. In the following, the term "spring bows" is used for the first and second spring bows.

In the teaching according to the invention, the insulating housing can be formed of a basic housing and a cover part which is inserted and locked into the basic housing.

Independently or in combination with the conductor connection terminal according to the invention, the second clamping limb can have a second clamping edge, wherein the second clamping edge and the second contact portion of the busbar form the second clamping point for a contact pin that is to be clamped. This has the advantage that the contact pin that is to be clamped can be reliably held in the second clamping point. Inadvertent removal of the contact pin from the second clamping point is therefore no longer possible. This development is independent of the conductor connection terminal described above and does not require a first spring bow and second spring bow arranged at a common height level. This further development can therefore be combined with the subject of the preamble of claim 1 without the characterizing part.

The first spring bow and the second spring bow can be bent in an opposite direction from the bearing limb. The clamping spring is then S-shaped. This allows for the electrical conductor and the contact pin to be inserted parallel to each other, while the electrical conductor and the contact pin can be inserted at different levels at the same time.

The first contact portion and/or the second contact portion can be T-shaped. Such an embodiment of the first contact portion and/or the second contact portion of the busbar allows for a large contact surface of the electrical conductor that is to be clamped or of the contact pin that is to be clamped, so that the electrically conductive connection between contact pin and busbar and/or electrical conductor and busbar is significantly improved.

The first contact portion and the second contact portion can be connected to each other by means of a connecting portion of the busbar, wherein the first contact portion and/or the second contact portion is formed orthogonal to the connecting portion of the busbar. In this way, a busbar can be provided which further reduces the required installation space by providing only the necessary space for an electrical conductor that is to be clamped and a contact pin that is to be clamped.

The busbar can have a passage opening, wherein at least one recess is arranged at the passage opening and wherein the clamping spring is mounted on the busbar via the recess. The clamping spring can be hooked into the recess in such a way that it is held self-supporting.

The conductor connection terminal may have an actuating element, wherein the actuating element interacts with the first clamping limb and is set up to open or close the first clamping point. It is also advantageous if the actuating element is an actuating lever, wherein the actuating lever can be swiveled via a swivel bearing.

In this way, a conductor connection terminal can be provided which enables easy operation. The clamping spring is displaced by the actuating lever when the clamping point is opened so that an electrical conductor can be inserted. This can be achieved, for example, by raising or lowering the first clamping limb of the clamping spring.

The first clamping point can be located in the region of the swivel bearing of the actuating lever. In this way, a space-saving conductor connection terminal with a lever actuation can be provided, wherein the swivel bearing of the actuating lever is arranged in the region of the first clamping point, for example laterally next to the electrical conductor that is to be clamped.

Independently or in combination with the inventive conductor connection terminal, the contact pin insertion channel can be arranged on a common plane with the actuating lever. For example, the actuating lever can be located downstream of the contact pin insertion channel and thus downstream of the contact pin that is to be clamped, so that the actuating lever does not increase the overall height of the conductor connection terminal, but uses the available length to provide a compact conductor connection terminal with a lever actuation. This further development is independent of the conductor connection terminal described above and does not require a first spring bow and second spring bow arranged at a common height level. This further development can thus be combined with the subject of the preamble of claim 1 without the characterizing part.

It can be advantageous if the length of the clamping spring in the direction of longitudinal extent of the conductor insertion channel is greater than the width of the clamping spring transverse to the direction of longitudinal extent of the conductor insertion channel. In this way, the installation space of the conductor connection terminal can be stretched in length so that all necessary components can be installed in the conductor connection terminal, while keeping the height or width of the conductor connection terminal as small as possible.

It can be advantageous if several busbars with associated clamping springs are arranged in the insulating material housing, wherein a conductor insertion opening leading to one of the first clamping points is provided in the insulating material housing and wherein a contact pin insertion opening leading to one of the second clamping points is provided in the insulating material housing. Conductor connection terminals with different numbers of poles depending on the application are thus conceivable.

The bearing limb of the clamping spring can have two opposite bows in the region of the bearing on the busbar. Thus, by simple design measures, a first spring bow can be provided which is on the same height level as the second spring bow due to the opposite bow of the bearing limb.

However, it is also conceivable that the offset of the bearing limb can be realized in another manner. For example, it may be possible to achieve the offset via two 90° angles (starting from a 360° system). This has the advantage that a corresponding clamping spring can be punched out of a corresponding material without any further processing step being necessary to bend the bearing limb into its corresponding shape.

The undefined term "a" is to be understood as such and not as a numerical value. For example, for a multi-pole conductor connection terminal, the insulating material housing may also have additional conductor insertion openings, contact pin insertion openings, busbars and associated clamping springs.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
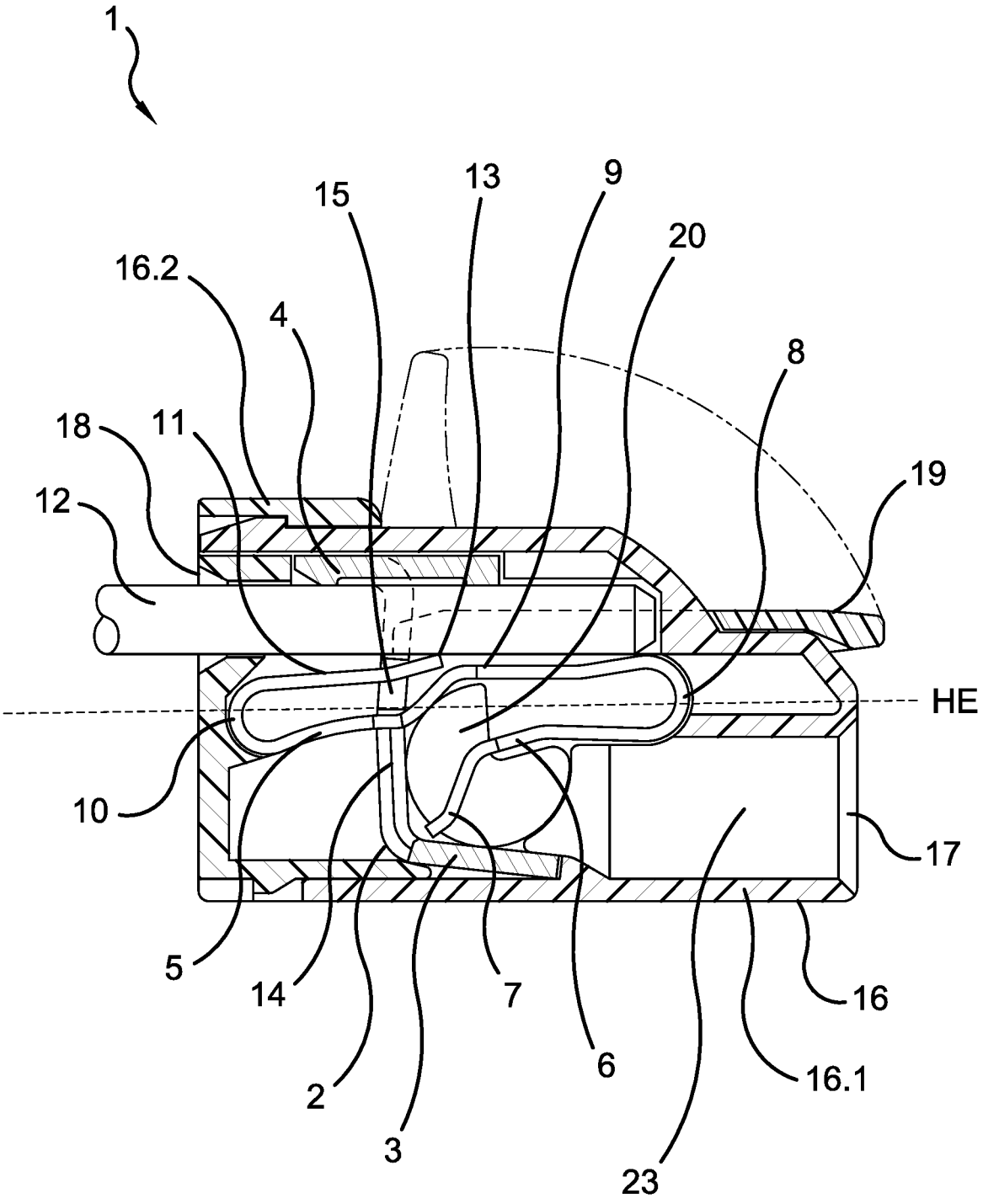
FIG. 1 shows a conductor connection terminal in a side sectional view.

FIG. 1 shows a side view of a conductor connection terminal 1 with a busbar 2, wherein the busbar 2 has a first contact portion 3 and a second contact portion 4. The conductor connecting terminal 1 also has a clamping spring 5, wherein the clamping spring 5 has a first clamping limb 6 with a first clamping edge 7 oriented towards the first contact portion 3. The first clamping edge 7 and the first contact portion 3 of the busbar 2 form a first clamping point for an electrical conductor that is to be clamped.

The first clamping limb 6 merges into a first spring bow 8, which extends into a bearing limb 9. The diametrically opposite end of the bearing limb 9 is followed by a second spring bow 10, which merges into a second clamping limb 11. The second clamping limb 11 and the second contact portion 4 of the busbar 2 form a second clamping point for a contact pin 12 that is to be clamped. It is clear that the second clamping limb 11 has a second clamping edge 13 which holds the contact pin 12 in place. The contact pin 12 can therefore no longer be detached from the conductor connection terminal 1 without additional aids.

The first contact portion 2 and the second contact portion 3 of the busbar 2 are connected to each other via a connecting portion 14. The connecting portion 14 has a passage opening 15, with lateral recesses (not shown in FIG. 1) at the passage opening 15. The clamping spring 5 is passed through the passage opening 15, wherein the bearing limb 9 is held self-supporting in the lateral recesses. The connecting portion 14 of the busbar is thus frame-shaped.

It can be seen that the first contact portion 2 and the second contact portion 3 of the busbar protrude essentially orthogonally from the connecting portion 14. It is also clear that the second contact portion 3 is T-shaped. The contact pin 12 can thus be clamped flat to the second contact portion 3 so that a good electrically conductive connection is created.

The busbar 2 and the clamping spring 5 are arranged as contact insert in an insulating material housing 16. A conductor insertion opening 17 is arranged at the insulating material housing 16, wherein a conductor insertion channel 23 is connected to the conductor insertion opening 17. An electrical conductor can be inserted into the conductor connection terminal via the conductor insertion opening 17 and the attached conductor insertion channel 23. On the opposite side of the conductor insertion opening 17, a contact pin insertion opening 18 with an attached contact pin insertion channel (concealed by the contact pin 12) is arranged in the insulating material housing 16, wherein the contact pin 12 can be inserted into the conductor connection terminal 1 via the contact pin insertion opening 18 and the contact pin insertion channel. The insulating material housing 16 formed of a basic housing 16.1 and a cover part 16.2 which is inserted and locked into the basic housing 16.1.

However, the inventive embodiment is not limited to a single-pole version. Rather, it is conceivable that several busbars and associated clamping springs are arranged in the insulating material housing, wherein in each case a conductor insertion opening that opens out to one of the first clamping points is provided in the insulating material housing and wherein in each case a contact pin insertion opening that opens out to one of the second clamping points is provided in the insulating material housing. Thus, the conductor connection terminal according to the invention is suitable for any conceivable number of poles.

It can be seen that the bearing limb 9 of the clamping spring 5 in the region of the bearing of the bearing limb at the connecting portion 14 of the busbar 2 has an offset due to two successive bows in opposite directions. It becomes clear that due to the offset of the bearing limb 9, the first spring bow 8 and the second spring bow 10 are essentially arranged at a common height level HE.

In this case, the height level HE runs through the vertices of the first spring bow 8 and the second spring bow 10, wherein the height level HE is essentially parallel to the direction of longitudinal extent of the conductor insertion channel 23 and the direction of longitudinal extent of the contact pin insertion channel. A common height level HE of the first spring bow 8 and the second spring bow 10 allows for a particularly compact conductor connection terminal 1 to be achieved which requires only a low overall height.

The conductor connection terminal 1 has an actuating lever 19 that is set up to open or close the first clamping point. The actuating lever 19 can be swiveled via a swivel bearing 20. The swivel bearing 20 is located laterally next to the first clamping point. A contour 23 of the swivel bearing 20 interacts with the first clamping limb 6 in such a way that by swiveling the actuating lever 19, the first clamping limb 6 is raised or lowered and thus the first clamping point can be opened or closed.

It is clear that the first clamping point is located in the region of the swivel bearing 20. Thus, a compact conductor connection terminal 1 can be realized with minimum overall height by arranging the swivel bearing 20 laterally next to the first clamping point.

Furthermore, it can be seen that the contact pin insertion channel is on a common plane with the actuating lever 19 or at least with its grip element. In this way, the overall height of the conductor connection terminal 1 can be kept to a minimum.

Figure 2:
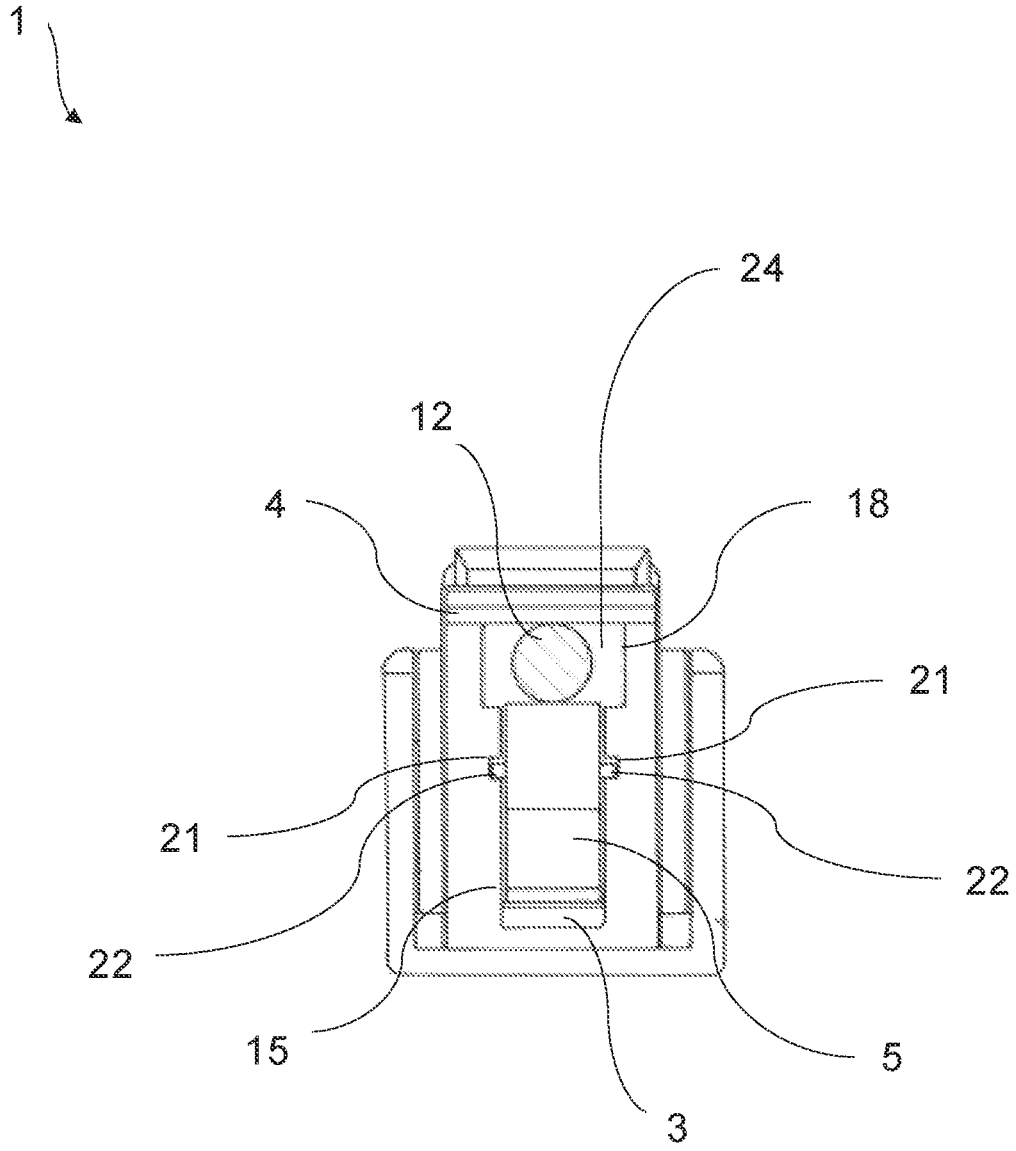
FIG. 2 shows a conductor connection terminal as shown in FIG. 1 in a sectional view rotated by 90°.

FIG. 2 shows a conductor connection terminal 1 according to FIG. 1 in a 90° rotated side view. The conductor connection terminal 1 can be seen with a frontal view of the contact pin insertion opening 18, with the contact pin 12 inserted into the contact pin insertion channel 24. It is clear that the connecting portion 14 of the busbar 2 is frame-shaped, wherein the first contact portion 3 and the second contact portion 4 project orthogonally from the connecting portion 14.

It is also clear that the clamping spring 5 protrudes through the passage opening 15 of the frame-shaped connecting portion 14 of the busbar 2, wherein the clamping spring 5 is hooked into two lateral recesses 21 of the passage opening 15. The clamping spring 5 is supported in a self-supporting manner by two projecting pins 22 in the lateral recesses 21 of the passage opening 15. The pins 22 can, for example, be formed in one piece from the clamping spring 5. However, it is also conceivable that the pins 22 are attached separately to the clamping spring 5.

Figure 3:
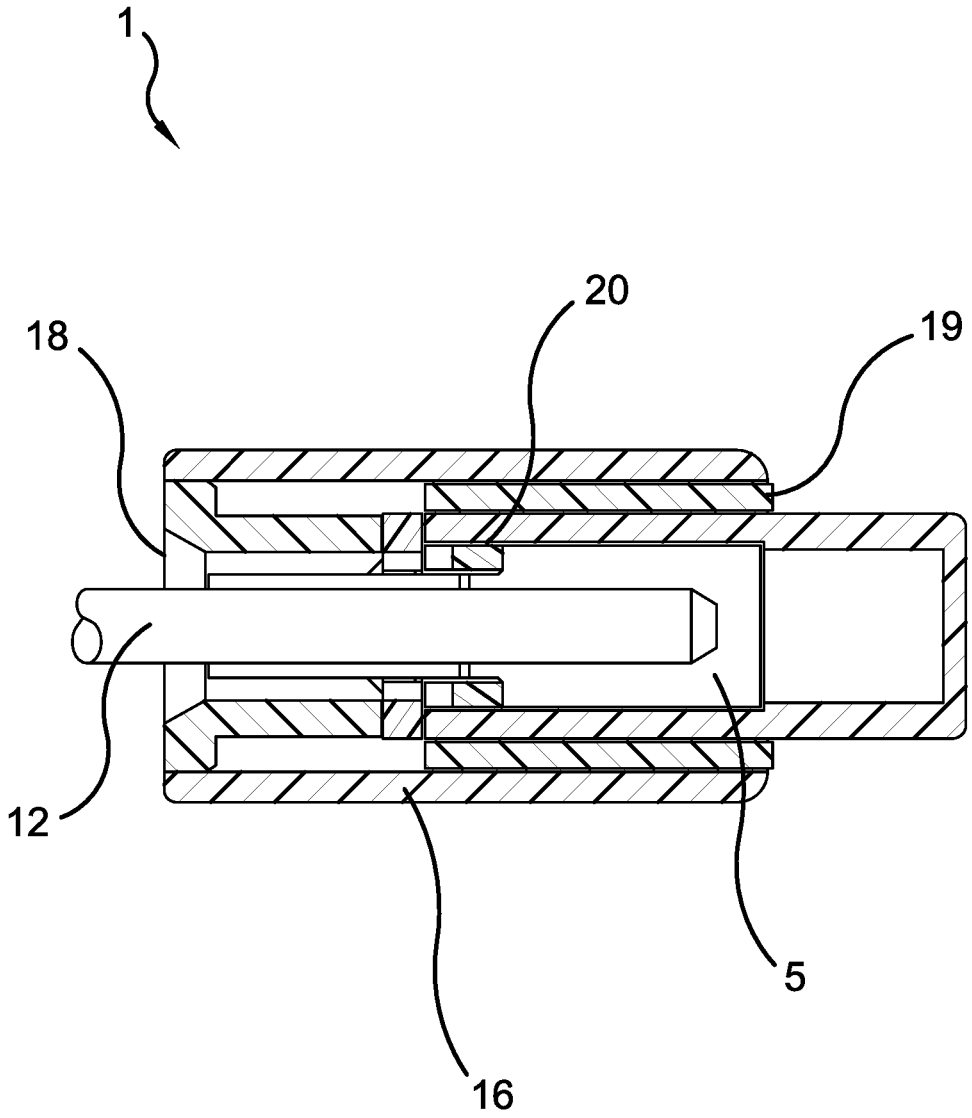
FIG. 3 shows a conductor connection terminal according to FIG. 1 in a cut plan view.

FIG. 3 shows a conductor connection terminal 1 according to FIG. 1 in a cut plan view. Shown is a contact pin 12, which is inserted via the contact pin insertion opening 18 and the attached contact pin insertion channel into the insulating material housing 16 towards the second clamping point. It is clear that the contact pin insertion channel and thus also the contact pin 12 are arranged on the same plane as the actuating lever 19. The actuating lever 19 is located downstream of the contact pin insertion channel and thus also downstream of the contact pin 12, so that the actuating lever 19 does not require any additional overall height and the conductor connection terminal 1 can thus be designed compactly.

It can also be seen that the actuating lever 19 embraces the second clamping point with two lateral arms 24, so that the contact pin 12 can be held in the second clamping point by the clamping spring 5, between the arms 24 of the actuating lever 19. However, it would also be conceivable to laterally embrace the second clamping point with only one arm 24 on the actuating lever 19. The actuating lever 19 is swiveled via the swivel bearing 20 when the clamping point is opened or closed. The swivel bearing 20 is only partially visible in FIG. 2, since it is covered by the clamping spring 5.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A conductor connection terminal comprising:

an insulating material housing having a conductor insertion opening, a conductor insertion channel attached to the conductor insertion opening, and a contact pin insertion opening with a contact pin insertion channel attached to the contact pin insertion opening;

a busbar having a first contact portion and a second contact portion; and a clamping spring having a first clamping limb with a first clamping edge oriented towards the first contact portion of the busbar, a first spring bow, a bearing limb, a second spring bow, and a second clamping limb, wherein the first clamping edge of the clamping spring and the first contact portion of the busbar form a first clamping point for an electrical conductor that is to be clamped, wherein the second clamping limb of the clamping spring and the second contact portion of the busbar form a second clamping point for a contact pin that is to be clamped, wherein the first spring bow is connected to the second spring bow via the bearing limb, wherein the first spring bow and the second spring bow are essentially arranged at a common height level of the conductor connector terminal, wherein the common height level is substantially parallel to a direction of longitudinal extent of the conductor insertion channel and/or a direction of longitudinal extent of the contact pin insertion channel, wherein the busbar has a passage opening, wherein at least one recess is arranged at the passage opening and wherein the clamping spring is mounted in the passage opening of the busbar via the at least one recess, wherein the passage opening is a through-hole that is enclosed on all sides by material of the busbar, wherein the second clamping limb has a second clamping edge, wherein the second clamping edge and the second contact portion of the busbar form the second clamping point for the contact pin that is to be clamped, and wherein the first spring bow and the second spring bow are bent in an opposite direction from the bearing limb, such that, in an unstressed state of the first clamping limb and the second clamping limb, the second clamping edge of the second clamping limb and the first clamping edge of the first clamping limb are positioned at different height levels from one another, each of the height levels being different from the common height level of the first spring bow and the second spring bow.

2. A conductor connection terminal comprising:

an insulating material housing having a conductor insertion opening, a conductor insertion channel attached to the conductor insertion opening, and a contact pin insertion opening with a contact pin insertion channel attached to the contact pin insertion opening;

a busbar having a first contact portion and a second contact portion; and a clamping spring having a first clamping limb with a first clamping edge oriented towards the first contact portion of the busbar, a first spring bow, a bearing limb, a second spring bow, and a second clamping limb, wherein the first clamping edge of the clamping spring and the first contact portion of the busbar form a first clamping point for an electrical conductor that is to be clamped, wherein the second clamping limb of the clamping spring and the second contact portion of the busbar form a second clamping point for a contact pin that is to be clamped, wherein the first spring bow is connected to the second spring bow via the bearing limb, wherein the first spring bow and the second spring bow are essentially arranged at a common height level of the conductor connector terminal, wherein the common height level is substantially parallel to a direction of longitudinal extent of the conductor insertion channel and/or a direction of longitudinal extent of the contact pin insertion channel, wherein the bearing limb directly contacts the busbar so as to be supported on the busbar, wherein the second clamping limb has a second clamping edge, wherein the second clamping edge and the second contact portion of the busbar form the second clamping point for the contact pin that is to be clamped, and wherein the first spring bow and the second spring bow are bent in an opposite direction from the bearing limb, such that, in an unstressed state of the first clamping limb and the second clamping limb, the second clamping edge of the second clamping limb and the first clamping edge of the first clamping limb are positioned at different height levels from one another, each of the height levels being different from the common height level of the first spring bow and the second spring bow.

3. A conductor connection terminal comprising:

an insulating material housing having a conductor insertion opening, a conductor insertion channel attached to the conductor insertion opening, and a contact pin insertion opening with a contact pin insertion channel attached to the contact pin insertion opening;

a busbar having a first contact portion and a second contact portion; and a clamping spring having a first clamping limb with a first clamping edge oriented towards the first contact portion of the busbar, a first spring bow, a bearing limb, a second spring bow, and a second clamping limb, wherein the first clamping edge of the clamping spring and the first contact portion of the busbar form a first clamping point for an electrical conductor that is to be clamped, wherein the second clamping limb of the clamping spring and the second contact portion of the busbar form a second clamping point for a contact pin that is to be clamped, wherein the first spring bow is connected to the second spring bow via the bearing limb, wherein the first spring bow and the second spring bow are essentially arranged at a common height level of the conductor connector terminal, wherein the common height level is substantially parallel to a direction of longitudinal extent of the conductor insertion channel and/or a direction of longitudinal extent of the contact pin insertion channel, wherein the bearing limb of the clamping spring has two bends in opposite directions in a region where the bearing limb is supported on the busbar, wherein the second clamping limb has a second clamping edge, wherein the second clamping edge and the second contact portion of the busbar form the second clamping point for the contact pin that is to be clamped, and wherein the first spring bow and the second spring bow are bent in an opposite direction from the bearing limb, such that, in an unstressed state of the first clamping limb and the second clamping limb, the second clamping edge of the second clamping limb and the first clamping edge of the first clamping limb are positioned at different height levels from one another, each of the height levels being different from the common height level of the first spring bow and the second spring bow.

4. The conductor connection terminal according to claim 3, wherein the first contact portion and/or the second contact portion of the busbar is T-shaped.

5. The conductor connection terminal according to claim 3, wherein the first contact portion and the second contact portion of the busbar are connected to each other via a connecting portion of the busbar, wherein the first contact portion and/or the second contact portion are formed orthogonally to the connecting portion of the busbar.

6. The conductor connection terminal according to claim 3, wherein the busbar has a passage opening, wherein at least one recess is arranged at the passage opening and wherein the clamping spring is mounted in the passage opening of the busbar via the at least one recess.

7. The conductor connection terminal according to claim 3, wherein the conductor connection terminal has an actuating element, wherein the actuating element interacts with the first clamping limb and is arranged for opening or closing the first clamping point.

8. The conductor connection terminal according to claim 7, wherein the actuating element is an actuating lever, wherein the actuating lever is swiveled via a swivel bearing.

9. The conductor connection terminal according to claim 8, wherein the first clamping point is arranged in a region of the swivel bearing of the actuating lever.

10. The conductor connection terminal according to claim 8, wherein the contact pin insertion channel is arranged on a common plane with the actuating lever.

11. The conductor connection terminal according to claim 8, wherein when the actuating lever is in a closed position in which the first clamping point is closed, a longitudinal extent of the actuating lever is aligned with the longitudinal extent of the contact pin insertion channel.

12. The conductor connection terminal according to claim 3, wherein a length of the clamping spring in the direction of longitudinal extent of the conductor insertion channel is greater than a width of the clamping spring transversely to the direction of longitudinal extent of the conductor insertion channel.

13. The conductor connection terminal according to claim 3, wherein the conductor connection terminal is adapted to contact a contact pin.

14. The conductor connection terminal according to claim 3, wherein the two bends of the bearing limb are provided between, and spaced apart from, the first spring bow and the second spring bow.

* * * * *